United States Patent [19]

Moore

[11] 4,372,354

[45] Feb. 8, 1983

[54] CONDIMENT DISPENSER

[75] Inventor: Albert R. Moore, Miami, Fla.

[73] Assignee: Burger King Corporation, Miami, Fla.

[21] Appl. No.: 144,155

[22] Filed: Apr. 28, 1980

[51] Int. Cl.[3] ..... B67D 5/54

[52] U.S. Cl. ..... 141/361; 222/639; 222/145; 222/399

[58] Field of Search ..... 222/70, 134, 135, 144.5, 222/145, 394, 397, 399, 639; 251/30; 99/450.7, 645; 137/143; 141/361, 362, 363

[56] References Cited

U.S. PATENT DOCUMENTS

| | | | |
|---|---|---|---|
| 1,849,945 | 3/1932 | Mobley et al. | 239/143 |
| 2,751,114 | 6/1956 | Greaves | 222/70 |
| 3,203,595 | 8/1965 | Berkowitz | 222/144.5 X |
| 3,445,039 | 5/1969 | Brodsky et al. | 222/70 |
| 3,981,478 | 9/1976 | Lundsgart | 251/30 X |
| 4,135,696 | 1/1979 | Saarem et al. | 251/30 |
| 4,143,688 | 3/1979 | Gill, Jr. et al. | 222/144.5 X |

*Primary Examiner*—Robert B. Reeves
*Assistant Examiner*—Edward M. Wacyra
*Attorney, Agent, or Firm*—Michael D. Ellwein; Robert J. Lewis; Mart C. Matthews

[57] ABSTRACT

A dispensing apparatus adapted for dispensing a predetermined amount of one or more condiments or other fluids onto a sandwich or the like. The dispenser includes a stand supporting a nozzle which is connected in flow communication by conduits to at least one source of condiment. A valving arrangement and associated controllers are operatively connected to the conduits between the nozzle and the source of the condiment for selectively allowing a predetermined quantity of condiment to be dispensed through the nozzle.

10 Claims, 7 Drawing Figures

CONDIMENT DISPENSER

FIELD OF THE INVENTION

The present invention relates to a dispenser which is adapted for automatically dispensing a predetermined amount of condiment or the like onto a sandwich or the like in response to actuation by an operator.

BACKGROUND OF THE INVENTION

The fast food industry is an extremely competitive business. In order to remain competitive, it is paramount that a restaurant provide fast and efficient service and consistent quality products. If one cannot achieve this, then business will fall as will profits and market share. Thus, it is extremely important, particularly for chain restaurants, to be able to provide fast and efficient service with quality and consistent food products, not only within a single restaurant, but from restaurant to restaurant.

One of the major problems attendant with achieving the aforementioned objectives is with the restaurant staff. The nature of the business is that there will be a high turnover rate, a large number of employees working at one time and a change of personnel because of different working schedules throughout the day to accommodate what is normally a staff of young people, typically high school students.

To further compound this, each individual worker will prepare the food in a manner more suitable to his or her own particular taste, i.e., one person will prefer more spice or more flavor than another person. Further, with the exigencies of rush time in a restaurant, many single items of food are being handled in a very limited amount of time and space to accommodate the rush. What this leads to is a wide variation in the amount of condiment placed on a sandwich which gives an appearance of lack of consistency, unacceptable or questionable acceptability of the food and sometimes slow service to the consumer. What the restaurant sees is inefficiency, additional cost and lack of acceptance of the food product being served.

In preparing sandwiches, mustard and ketchup have extremely strong flavors which can mask the flavor of the remainder of the sandwich or overflavor it to a degree that it becomes unacceptable to a substantial portion of the consuming public. This is particularly true of mustard which has an extremely strong, masking flavor. The control of the amount of mustard and ketchup placed on a sandwich, as described above, has to date been difficult, if not almost impossible, to achieve. Typically, control of the quantity has been by employee training, manager observation and control.

The present invention provides an apparatus for overcoming the aforementioned problem in a simple and inexpensive manner. The invention lends itself to simplicity and speed of operation by any one of a number of different employees while still providing consistent results. Because of its design and simplicity, it is virtually foolproof in operation by what is normally a minimally trained employee. It also requires minimal or no counter space, which is a premium item in most fast food restaurants. Further, it can be adjusted before use and simply adjusted thereafter in order to vary the quantity of condiment dispensed.

An object of the present invention is to provide a condiment dispenser which is simple to operate and requires a minimum of training to teach an operator how to operate the dispenser.

Another object of the present invention is to provide a dispenser which is positive in operation and provides consistent results. A still further object of the present invention is to provide an apparatus which can be simply adjusted to vary the quantity of condiment to be dispensed, if such adjustment is needed.

Another object of the present invention is to provide an apparatus which will uniformly distribute condiment over substantially the entirety of the sandwich so that consistent flavor from bite to bite can be achieved. Another object of the present invention is to provide an apparatus which requires a minimum of counter space. A still further object of the present invention is to provide an apparatus which is inexpensive to manufacture, positive in operation and easy to maintain.

Other objects and advantages of the present invention will become apparent from the following detailed description taken in connection with the accompanying drawings wherein are set forth by way of illustration and examples certain embodiments of the present invention.

DETAILED DESCRIPTION OF THE INVENTION

Figure 1:
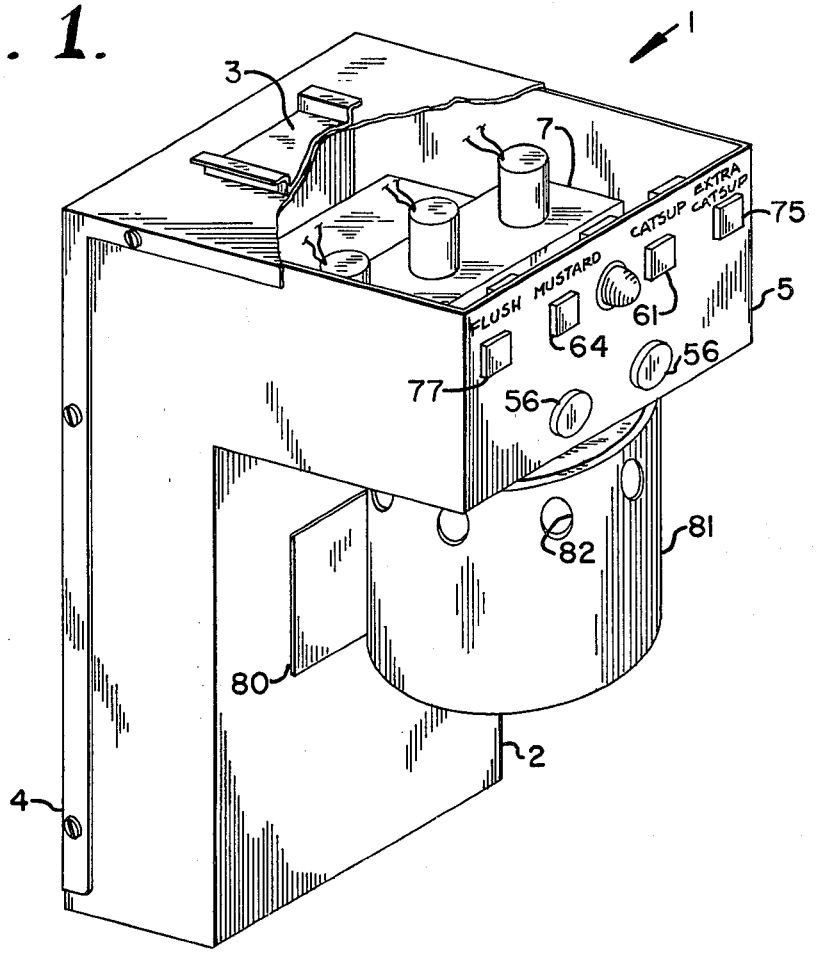
FIG. 1 is a perspective view of the dispenser with portions broken away to show details thereinside.

The reference numeral 1 designates generally a dispenser which includes a housing 2. The housing 2 includes an upright portion 4 and a head portion 5 with a bracket 3 adapted for engagement with a mounting bracket (not shown) attached to a counter cabinet to suspend the dispenser 1 above the counter. The head 5, as illustrated, projects outwardly over the base 3 for convenience in operation. The upright 4 and head 5 house various portions of the dispenser 1 in an enclosed condition for sanitation and safety reasons.

Figure 2:
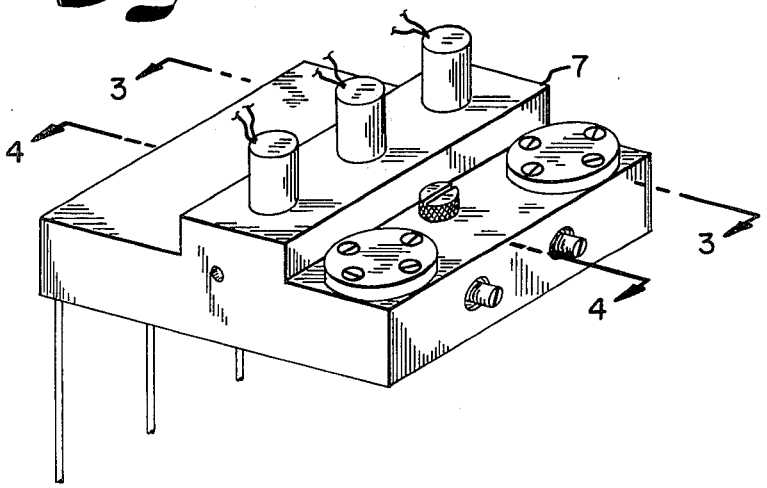
FIG. 2 is a perspective view of a block which contains valve means and conduit means for controlling and directing the flow of condiment.
Figure 3:
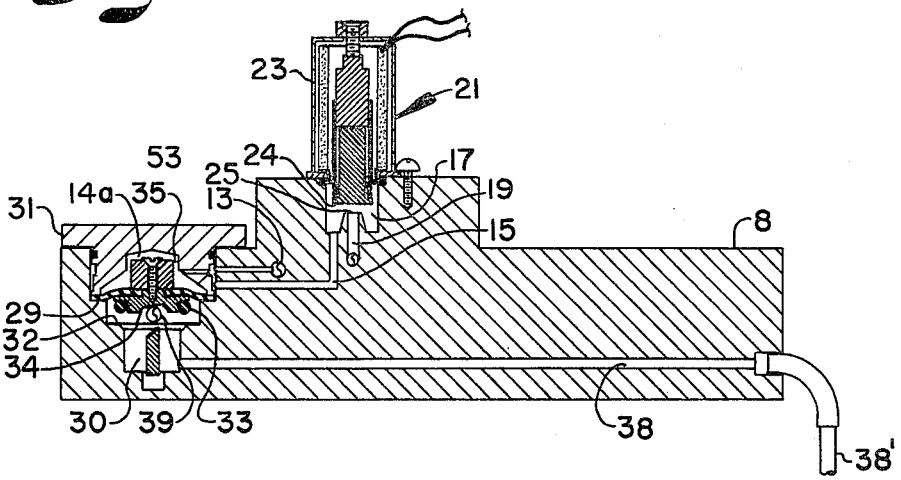
FIG. 3 is a sectional view taken along the line 3—3, FIG. 2.
Figure 4:
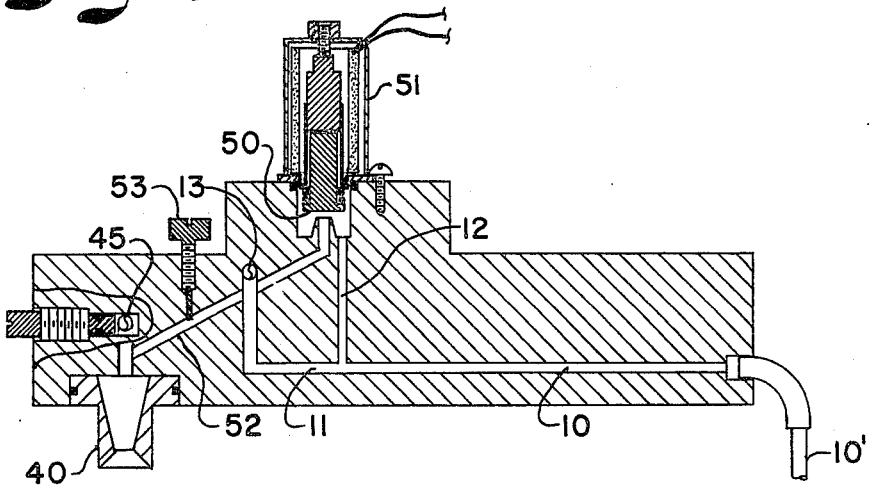
FIG. 4 is a sectional view of the blocks taken along the line 4—4, FIG. 2.
Figure 5:
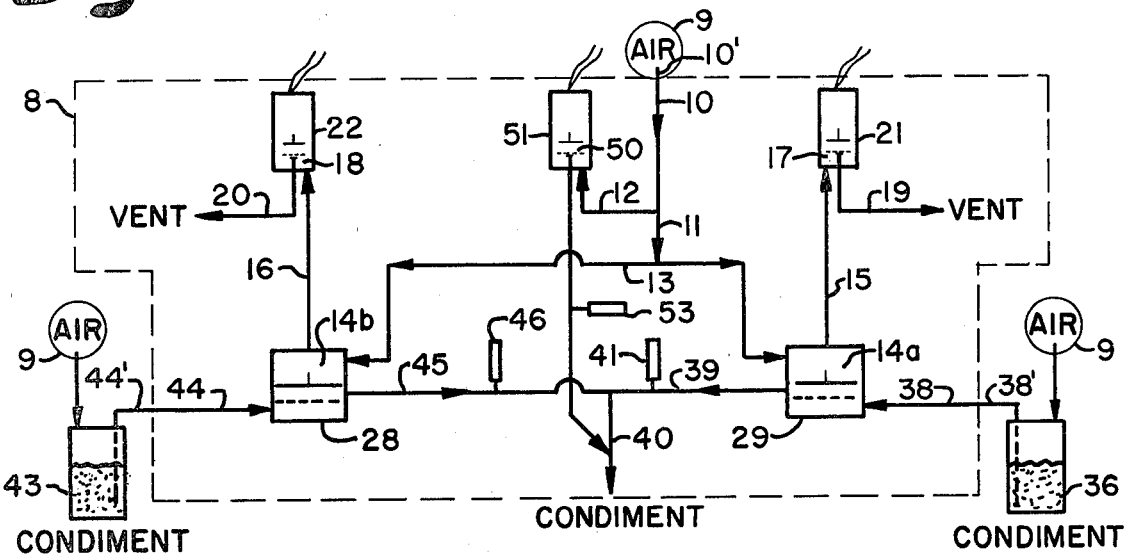
FIG. 5 is a schematic illustration of the valving and conduit of the dispenser.

Valve means 7 is mounted in the stand 2, preferably in the head 5. The valve means 7 is best seen in FIGS. 2, 3, and 4 and is schematically shown in FIG. 5. In a preferred form of the invention, the valve means includes a body or block 8 which can be in one piece or a plurality of pieces to facilitate manufacture. The block 8 contains various passages and valves to effect selective dispensing of condiment onto a sandwich or the like. With the exception of the sources of condiment, the source of pressurized gas and the conduits connecting these to the body 8, the conduits and valves illustrated in FIG. 5 are contained within the block 8. This allows for simplicity of manufacture and compactness.

The dispenser 1 can be constructed for the dispensing of only one condiment or can be constructed for the dispensing of 2 or more condiments as is desired. However, the basic structure would still be the same as described and the valving would still be substantially as shown in FIG. 5 with the elimination of or the addition of valving for additional sources of condiment.

A source 9 of pressurized gas, such as air or $CO_2$ is connected to a conduit 10, which is a passage in the block 8 in the illustrated structure by a conduit 10. The conduit 10 is in turn connected in flow communication to conduits 11 and 12 also which are passages in the block 8. The conduit 11 is connected to a conduit 13, which is in the block 8, which in turn is connnected to one or more chamber which, in the illustrated structures, are chambers 14*a* and 14*b*. The conduit 13 is connected in flow communication with conduits 15 and 16, which are in the block 8, via the respective chambers 14*a* and 14*b*. The conduit 15 is connected in flow communication with a valve chamber 17 and the conduit 16 is connected in flow communication to a valve chamber 18. Conduits 19 and 20, which are in the block 8, are each connected in flow communication with the respective valve chambers 17 and 18 and open to the atmosphere at the exterior of the block 8.

Valve means 21 and 22 are each operably connected to the respective sets of conduits 15 and 19 and 16 and 20 for a purpose later described. The valve means 21 and 22, in the illustrated structure, are the same and a description of one applies to the other. As best seen in FIG. 3, the valve means 21 includes a solenoid 23 which is preferably electrically operated and connected to control means later described. On the plunger of the solenoid 23 there is mounted a valve member 24 which is movable by reciprocal movement of the plunger of the solenoid 23. The valve member 24 is resiliently biased to an extended position to sealingly engage a valve seat 25 which surrounds the opening to the conduit 19. When in the extended position, the conduit 15 will remain pressurized via the pressurized gas from the source 9. When in the retracted position, the pressurized gas will be allowed to flow into the conduit 19 and out to relieve the pressure in the conduit 15 and chamber 14*a*.

Valve means 27 and 28 are positioned within respective chambers 14*a* and 14*b* in the block 8. The valve means 27 and 28 in the illustrated structure are the same and a description of one applies to the other. As best seen in FIG. 3, the valve means 27 includes a flexible diaphragm 29 which forms a seal between the chamber 14*a* and a lower chamber 30. The diaphragm 29 is held in its sealing condition by a cap 31 which is removably mounted on the block 8. A valve seat 32 defines a portion of the chamber 30 and is adapted for sealing engagement with a seal element 33 such as an O-ring which is mounted on a valve body 34. Preferably, a spring 35 resiliently biases the seal 33 into sealing engagement with the seat 32. A source of condiment 36 is connected in flow communication with the chamber 30 via a conduit 38, which is a passage in the block 8 and a conduit 38. The source of condiment is such that it is pressurized to force condiment to flow into the conduit 38 and the chamber 30. Both pressurized air in the chamber 14*a* and the force applied by the spring 35 hold the valve 27 in a normally closed position preventing flow of condiment from the conduit 38 to a conduit 39 which is connected in flow communication with the chamber 30 and is in the block 8. The valve 27 selectively permits flow of condiment from the conduit 38 to the conduit 39. By releasing the gas pressure in the chamber 14*a*, the pressure of the condiment such as mustard or ketchup in the chamber 30 will force the valve 27 open, i.e., unseating the seal 33 from the seat 32 allowing condiment to flow into the conduit 39. The conduit 39 is connected in flow communication to a discharge 40 such as a nozzle, and when condiment flows through the conduit 39, it will be dispensed out of the nozzle 40. A metering adjustment screw 41 has an end positioned in the conduit 39 for adjusting flow of condiment in the conduit 39.

A source 43 of a second condiment is connected in flow communication to the valve 28 via a conduit 44 in the block 8 and a conduit 44 with the valve 28 functioning as does the valve 27. Condiment from the valve 28 flows through a conduit 45 which is also connected to the discharge 40 as is the conduit 39 and is in the block 8. A metering screw 46 like the metering screw 41 is in association with the conduit 45 for adjusting the flow rate of condiment flowing through the conduit 45.

Both the sources 36 and 43 of condiment can be a pressure tank which is connected to a source 9 of pressurized gas to maintain the condiment in the respective sources pressurized.

The conduit 12 is connected in flow communication to a valve chamber 50 which is similar to the valve chamber 17 and is in the block 8. A valve 51, like the valves 21 and 22, is associated with a conduit 52 which is in the block 8. The conduit 52 is connected in flow communication to the nozzle 40 and selectively provides pressurized gas to the nozzle to help fluidize and at least partially atomize the condiment being dispensed and spray it over a somewhat predetermined area under the nozzle 40. A metering screw 53 is provided in the conduit 52 for adjustment of the flow rate of air to the nozzle 40.

As best seen in FIGS. 1 and 2, the metering screws 41 and 46 are accessible through the front of the head 5 while the metering screw 53 is adjustable by removing a portion of the stand 2. Preferably, removable plugs 56 close access openings through the front of the head 5 which provide access to the metering screws 41 and 46.

Figure 6:
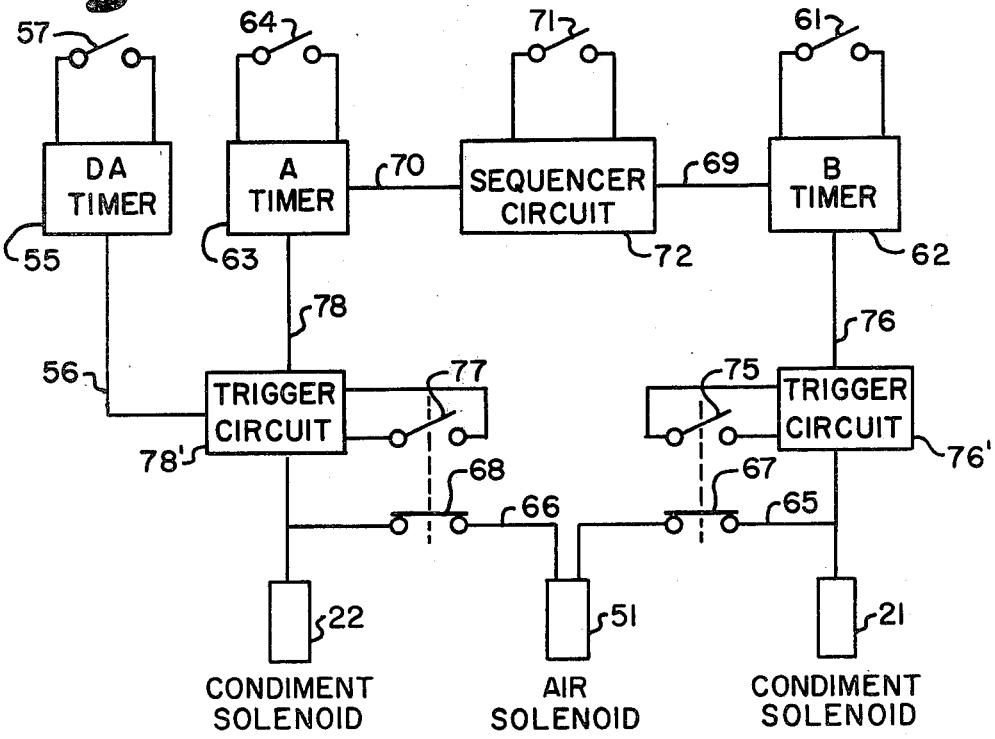
FIG. 6 is a functional schematic representation of the control circuit which regulates and effects operation of the dispenser.

The control mechanism for the dispenser 1 is schematically illustrated in FIG. 6. A source of current 6 provides the actuating current for control of the solenoid 21, 22 and 51. An actuator such as a switch 61 is electrically connected between the source 60 and a timer 62 which in turn is electrically connected to the solenoid 21 by a conductor 76 and a trigger circuit 76'. Upon closing of the switch 61, the timer 62 is actuated allowing the solenoid 21 to remain energized and retracted for a predetermined period of time. This allows the valve 27 to move to an open position and flow of condiment from the source 36 to flow to the nozzle 40 for a selected period of time. After timing, the timer 62 de-energizes the solenoid 21 allowing it to move to an extended position preventing flow of air out the conduit 19 thereby forcing the valve 27 to close terminating dispensing of condiment. The solenoid 22 is likewise electrically connected to a respective timer 63 and an actuator such as a switch 64 which functions the same as the switch 61 and timer 62 by a conductor 78 and a trigger circuit 78'. (The trigger circuits are model 05-0925 made by McCann's Engineering and Manufacturing Co. of Los Angeles, Calif.) Actuation of the switch 61 or 64 will effect dispensing of one of the other condiment as selected. The solenoid 51 is likewise connected to the timers 62 and 63 via conductors 65 and 66, respectively. Connected in the conductors 65 and 66 are respective, normally closed switches 67 and 68. Thus, when either the timer 62 or the timer 63 is actuated, the solenoid 51 is also energized permitting flow of compressed or pressurized air to the nozzle 40 through the conduits 52 and 12.

A timer 55, similar to the timer 62 or 63, is provided; however, it is optional and can be as shown associated with timer 63 and/or similarly associated with timer 62. The timer is electrically connected to the trigger circuit 78' by a conductor 56. An actuator or switch 57 is electrically connected to the timer 55 for selectively actuating the timer 55. By use of the parallel timers 55 and 63, different amounts of condiment can be selected with timer adjustment. (The timers 55, 62 and 63 are model 05-0924 made by McCann's Engineering and Manufacturing Co.)

Electrically connected to both the timers 62 and 63 is a sequencer such as model 05-0926 made by McCann's Engineering and Manufacturing Co. via conductors 69 and 70, respectively. A switch 71 is connected between the source 60 and the sequencer 72. Upon actuation or closing of the switch 71, first one timer, for example, timer 62, will be actuated, after which timer 63 will be actuated to provide sequential dispensing of condiments from the respective sources 36 and 43. The timers 62 and 63 and the sequencer 72 can be actuated by a pulse whereby the switches 61, 64 and 71 need only be momentarily depressed.

A switch 75 is electrically connected between the source 60 and the conductor 76 whereby an operator can actuate the switch 75 to energize the solenoid 21. The switches 75 and 67 are combination double pole double throw type switches whereby when the switch 75 is closed, the switch 67 opens so that air will not be discharged through the nozzle 40. This allows flushing of the one condiment through the system and out the nozzle 40. Likewise, the second condiment control circuit has a switch 77 electrically connnected between the source 60 and the conductor 78 to selectively energize the solenoid 22 to effect selective flushing of the second condiment through the nozzle 40 without the dispensing of air. The switch 77 is in combination with the switch 68 like the combination switch 75/67. A power source (not shown) such as a model 05-0927 made by McCann's Engineering and Manufacturing Co., is connected to and used to supply power to the control system.

Figure 7:
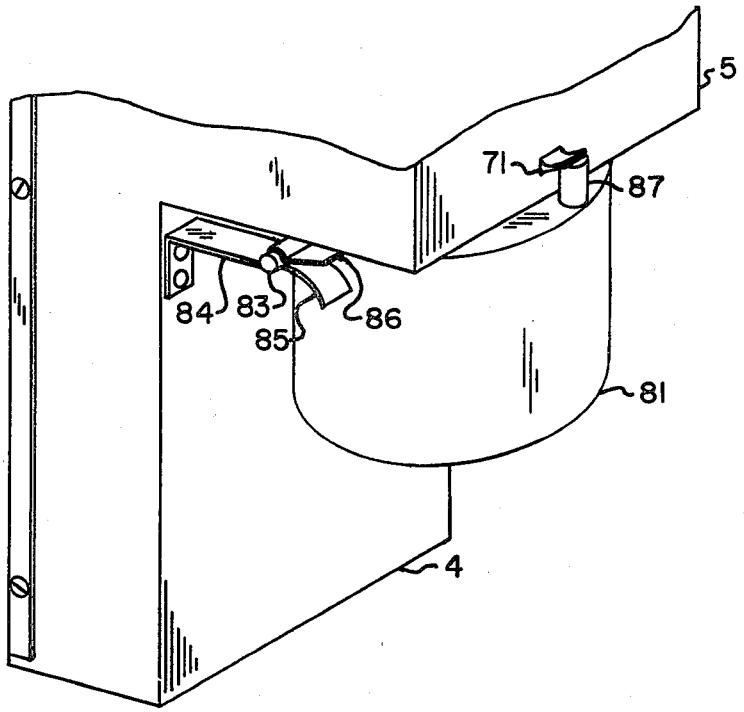
FIG. 7 is a fragmentary view of a modified form of the present invention showing details of the mounting of the shield and an actuating switch.

As seen in FIG. 1, a resilient diaphragm member 80 is mounted on the upright 4 behind a splash shield 81. When an operator places a sandwich or the like under the shield 81, the operator can, by simply moving the hand and sandwich upward, cause toggle switch closure, engage the flexible member 80. The switch 71 is mounted in the upright 4 behind the member 80 for actuation by an operator. As best seen in FIG. 7, the splash shield 81 is mounted on a pivot or hinge or is otherwise movable by an operator by engagement with the operator's hand. The switch 71, in this case, is mounted on the head 5 and upon movement of the splash shield 81, the switch 71 can be closed in an effective manner. The shield 81 can be mounted on the head in any suitable manner to achieve the aforementioned objectives. It is preferably a generally cylindrical hollow plastic tube having a plurality of circumferentially spaced apertures or vents 82 adjacent the upper end to allow venting of pressure and the like from the shield 81 during use.

FIG. 7 shows a modified form of the invention. In this form, the shield 81 is pivotlly mounted on the upright via pins 82 secured to the shield 81 and bearing members 84 which are secured to the upright 4. The bearing members 84, as shown, are each in the form of a pair of spring fingers 85 and 86 which receive a respective pin 83 therebetween thereby providing releasable retention. An actuator rod 87 is secured to the shield 81 and is in engagement with the switch 71 which in this form is mounted on the head 5. Pivoting movement of the shield 81 by the operator will move the rod 87 up to activate the switch 71 which is a momentary type and thereby actuate the sequencer 72 as described above.

It is to be understood that the foregoing is a description of the preferred embodiment of the present invention. The present invention is not to be limited to the specific form or arrangement of parts herein described and shown except to the extent that such limitations are set forth in the appended claims.

What is claimed is:

1. A dispenser for dispensing a predetermined amount of condiment on a sandwich, said dispenser comprising:

a source of condiment;

a source of pressurized gas;

first conduit means communicating with said source of condiment;

a discharge means;

second conduit means communicating with the discharge means;

first valve means communicating with said first and second conduit means selectively connecting the first and second conduit means in flow communication for selective flow of condiment from the source to the discharge means, said first valve means including a first valve which is normally closed to prevent flow of condiment, said first valve being held normally closed at least partially by fluid pressure, said first valve means including a second valve operably associated with said first valve for selectively reducing said fluid pressure allowing said first valve to open;

first control means operably connected to said second valve for selectively effecting opening and closing of said second valve, said first control means being operable for automatically regulating the amount of condiment dispensed to a predetermined amount, said first control means including a first actuator means operable for initiating operation of the first control means;

third conduit means communicating with said source of pressurized gas;

fourth conduit means communicating with said source of pressurized gas and said first valve to provide the fluid pressure to hold said first valve normally closed;

fifth conduit means communicating with said discharge means;

a third valve communicating with said third and fifth conduit means selectively connecting said third and fifth conduit means in flow communication, said third valve being operably connected to said first control means whereby said third valve is open when said first and second valves are open; and a stand having said discharge means and said first actuator means mounted thereon.

2. A dispenser as set forth in claim 1 including:

a source of second condiment;

sixth conduit means communicating with said source of second condiment;

seventh conduit means communicating with the discharge means;

second valve means communicating with said sixth and seventh conduit means selectively connecting the sixth and seventh conduit means in flow communication for selective flow of said second condiment from its source to the discharge means, said second valve means including a fourth valve which is normally closed to prevent flow of said second condiment, said fourth valve being held closed at least partially by gas pressure, said second valve means including a fifth valve operably associated with said fourth valve for selectively reducing the gas pressure in the fourth valve allowing said fourth valve to open, said first control means being operably connected to said fifth valve for selectively effecting opening and closing of said fifth valve, said first control means being operable for automatically regulating the amount of second condiment dispensed to a predetermined amount; and wherein said first control means includes:

a second actuator operably connected to said fifth valve for selectively effecting operation thereof independent of the second valve whereby only the second condiment will be dispensed; a third actuator operably connected to said second valve for selectively effecting operation thereof independent of the fifth valve whereby only the first condiment will be dispensed and wherein the first actuator is operably connected to the second valve and fifth valve for selectively effecting operation thereof whereby both the second condiment and the first condiment will be dispensed.

3. A dispenser as set forth in claim 2 wherein:

said first control means is operable upon actuation by the first actuator to effect operation of the second valve and fifth valve in sequence whereby the first condiment will be dispensed before dispensing of the second condiment.

4. A dispenser as set forth in claim 1 wherein:

said first actuator is mounted on said stand below said discharge means whereby an operator can actuate the first actuator with a hand which holds a sandwich when it is held beneath the discharge means.

5. A dispenser as set forth in claim 1, including:

a shield carried by said stand and positioned adjacent the discharge means to help locate a sandwich relative to the discharge means and prevent overspray of condiment; and wherein said first actuator is associated with said shield whereby movement of said shield by an operator can actuate the first actuator.

6. A dispenser for dispensing a predetermined amount of condiment on a sandwich, said dispenser comprising:

a source of condiment;

first conduit means communicating with said source of condiment;

a discharge nozzle;

second conduit means communicating with said nozzle;

first valve means communicating with the first and second conduit means selectively connecting the first and second conduit means in flow communication for selective flow of condiment from the source to the nozzle, said first valve means includes a first valve which is normally closed to prevent flow of condiment, said first valve being held normally closed at least partially by gas pressure, said first valve means including a second valve operably associated with said first valve for selectively reducing said gas pressure thereby allowing said first valve to open;

first control means operably connected to said first valve means for selectively effecting connection of the first conduit means in flow communication with the second conduit means, said first control means being operable for automatically regulating the amount of condiment dispensed to a predetermined amount, said first control means including a first actuator means operable for initiating operation of the first control means, said first actuator means having an actuating portion adjacent said nozzle;

a source of pressurized gas;

third conduit means communicating with said source of pressurized gas;

fourth conduit means communicating with said source of pressurized gas and said first valve to provide the gas pressure to hold said first valve normally closed;

fifth conduit means communicating with said discharge means;

a third valve communicating with said third and fifth conduit means selectively connecting said third and fifth conduit means in flow communication, said third valve being operably connected to said first control means whereby said third valve is open when said first and second valves are open; and a shield positioned adjacent said nozzle to locate a sandwich relative to said nozzle and prevent overspray of condiment.

7. A dispenser as set forth in claim 6, including:

a source of second condiment;

sixth conduit means communicating with said source of second condiment;

seventh conduit means communicating with the discharge means;

second valve means communicating with said sixth and seventh conduit means selectively connecting the sixth and seventh conduit means in flow communication for selective flow of second condiment from its source to the nozzle, said second valve means including a fourth valve which is normally closed to prevent flow of second condiment, said fourth valve being held closed at least partially by gas pressure, said second valve being held closed at least partially by gas pressure, said second valve means including a fifth valve operably associated with said fourth valve for selectively reducing the gas pressure in the fourth valve allowing said fourth valve to open, said first control means being operably connected to said fifth valve for selectively effecting opening and closing of said fifth valve, said first control means being operable for automatically regulating the amount of second condiment dispensed to a predetermined amount; and wherein said first control means includes:

a second actuator operably connected to said fifth valve for selectively effecting operation thereof independent of the second valve whereby only the second condiment will be dispensed;

a third actuator operably connected to said second valve for selectively effecting operation thereof independent of the fifth valve whereby only the first condiment will be dispensed and wherein the first actuator is operably connected to the second valve and fifth valve for selectively effecting operation thereof whereby both the second condiment and the first condiment will be dispensed.

8. A dispenser as set forth in claim 7 wherein:

said first control means is operable upon actuation by the first actuator to effect operation of the second valve and fifth valve in sequence whereby the first condiment will be dispensed before dispensing of the second condiment.

9. A dispenser as set forth in claim 6 wherein:

said first actuator is mounted on said stand below said nozzle whereby an operator can actuate the first actuator with a hand which holds a sandwich when it is held beneath the nozzle.

10. A dispenser as set forth in claim 6 including:

a shield carried by said stand and positioned adjacent the nozzle to help locate a sandwich relative to the nozzle and prevent overspray of condiment; and wherein said first actuator is associated with said shield whereby movement of said shield by an operator can actuate the first actuator.

* * * * *